US006550886B2

(12) United States Patent
Shimizu et al.

(10) Patent No.: US 6,550,886 B2
(45) Date of Patent: Apr. 22, 2003

(54) INK JET PRINTER CAPABLE OF ADJUSTING DEFLECTION AMOUNT IN ACCORDANCE WITH POSITIONAL SHIFT OF HEAD MODULES

(75) Inventors: Kazuo Shimizu, Hitachinaka (JP); Takahiro Yamada, Hitachinaka (JP); Shinya Kobayashi, Hitachinaka (JP); Kunio Satou, Hitachinaka (JP); Hitoshi Kida, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/014,401

(22) Filed: Dec. 14, 2001

(65) Prior Publication Data

US 2002/0075345 A1 Jun. 20, 2002

(30) Foreign Application Priority Data

Dec. 19, 2000 (JP) ..... 2000-385433

(51) Int. Cl.[7] ..... B41J 29/393; B41J 29/38; B41J 2/65

(52) U.S. Cl. ..... 347/19; 347/14; 347/23

(58) Field of Search ..... 347/19, 14, 12, 347/10, 11, 23, 8, 15, 57; 358/298

(56) References Cited

U.S. PATENT DOCUMENTS 5,610,637 A * 3/1997 Sekiya et al. ..... 347/10

FOREIGN PATENT DOCUMENTS

| | | | |
|---|---|---|---|
| EP | 0 974 468 A2 * | 7/1999 | ..... 347/19 |
| JP | 5-305734 | 11/1993 | |
| JP | 9-262992 | 10/1997 | |
| JP | 2000-127370 | 5/2000 | |

* cited by examiner

*Primary Examiner*—Hai Pham
*Assistant Examiner*—Charles W. Steward, Jr.
(74) *Attorney, Agent, or Firm*—Whitham, Curtis & Christofferson, P.C.

(57) ABSTRACT

An ink jet recording device 1 includes a plurality of head modules 101 each formed with a plurality of nozzles. The ink jet recording device 1 prints a test pattern using the all nozzle of the head modules 101. Precise positions of dots forming the test pattern are detected, based on which positional shifts of the head modules 101 are calculated. The deflection amount and ink ejection timing for each head module 101 are changed based on the detected positional shift. In this manner, positional shifts of the assembled head modules 101 are electrically corrected without mechanically changing the physical positions of the head modules 101.

17 Claims, 11 Drawing Sheets

INK JET PRINTER CAPABLE OF ADJUSTING DEFLECTION AMOUNT IN ACCORDANCE WITH POSITIONAL SHIFT OF HEAD MODULES

BACKGROUND OF THE INVENTION

1. Field of the Invention

The present invention relates to an ink jet recording device including a plurality of head modules for forming a high quality image at a high printing speed.

2. Related Art

A conventional serial-type ink jet recording device repeatedly performs a scanning operation and a feeding operation in alternation for forming an ink image on an elongated uncut recording sheet. Specifically, a print head of the recording device forms, in the scanning operation, a single-scan-worth of image on the recording sheet while scanning in a main scanning direction, which is a widthwise direction of the recording sheet. Then, the recording sheet is fed, in the feeding operation, in a secondary scanning direction perpendicular to the main scanning direction by a predetermined amount. After repetition of these operations, a whole image is completed.

In order to improve the printing speed of this type of ink jet recording device, there has been proposed to increase the amount of the image that the print head can form in a single scan. There has been also proposed to form the print head by assembling a plurality of short head modules in order to provide the print head with an elongated width.

When assembling the plurality of short head modules, the preciseness in assembling is important in producing a high quality image. However, it is hard to achieve the sufficiently precise assembling. In order to overcome this problem, Japanese Patent-Application Publication No. HEI-5-305734 proposes a method for adjusting the positional relationship among the assembled head modules. In this method, a test printing is performed to form line segments each extending perpendicular to the main scanning direction, and a distance between the line segments is measured. When the distance differs from a proper distance, actual printing is performed while shifting an image forming position, i.e., impact positions of ink droplets ejected from the head modules, on the recording sheet by an amount corresponding to the difference. In this way, positional shift of the head module with respect to the main scanning direction is cancelled out.

With respect to the secondary scanning direction, line segments perpendicular to the secondary scanning direction are formed, and a distance between the line segments is measured. When the distance differs form a proper one, then the actual positions of the head modules are mechanically moved by a corresponding amount. In this way, positional shift of the head modules with respect to both the main scanning direction and the secondary scanning direction can be adjusted.

There has been also proposed an ink jet recording device including a line-type ink jet head with a wide width formed with a large number of nozzles in one-to-one correspondence with the secondary scanning lines of the recording sheet. In this configuration, there is no need for the print head to scan in the main scanning direction at all, and printing can be performed while continuously feeding the recording sheet in the secondary scanning direction, thereby achieving high printing speed.

In one method, such a line-type ink jet head is produced by forming the nozzles in a straight line at once. However, this method requires a high production cost, because if even one of the nozzles is formed with uneven characteristics, then the overall image quality is degraded.

In order to avoid this problem, there is provided a method to form the head by assembling a plurality of short head modules each formed with nozzles. Because the head modules can be produced in lower cost, overall production cost of the print head can be suppressed. Thus produced print head can perform in the same manner as the print head formed with all nozzles at once.

In this case also, the preciseness in assembly is important but hard to achieve. Japanese Patent-Application Publication No. HEI-9-262992 discloses a method for adjusting the positional shift of the head modules that is inevitable during the assembly. A test pattern is formed by some of the nozzles of each print head or test nozzles provided only for printing the test pattern. Then, the positional shift of the head modules is detected based on the printed test pattern, and the positions of the head modules with respect to the main and secondary scanning directions are mechanically adjusted by using an adjustment mechanism.

Because an electrical manner can be used to adjust the positional shift of the head modules with respect to the main scanning direction, the mechanical manner and the electrical manner can be used in combination.

Japanese Patent-Application Publication No. 2000-127370 discloses a means for determining the positional relationship among the head modules based on printed test patterns. A plurality of test patterns is printed while an adjustment mechanism shifts the positions of the head modules. Then, the color density of the test patterns is detected by an optical sensor. Based on the detected color density, suitable positions of the head modules are determined.

SUMMARY OF THE INVENTION

However, because the positional adjustment is performed based on the test patterns that only some of the nozzles of each print head or the test nozzles have printed, characteristic differences among the all nozzles cannot be detected, and so positional adjustment needed for the characteristic differences cannot be adjusted. The characteristics of the nozzles include, for example, flying direction, flying speed, and volume of ink droplet ejected from each nozzle. The nozzle characteristics also vary depending on the ambient environment. Uneven characteristics among the nozzles cause positional shift of printed images and also degrades the image quality.

Also, in order to improve the preciseness in mechanically moving the head modules, the configuration of the adjustment mechanism will be complex. Also, because the adjustment mechanism is required, automatic adjustment is impossible.

Further, the amount of ink that spreads on the recording sheet varies depending on the ambient environment or the type of the recording sheet. The color density also varies depending on the recording sheet. These facts influence on the color density measurement and the like because dots are formed, in the test pattern printing, so close to one another or even overlapped intentionally. Because it is hard to avoid these influences, accurate determination of the positional relationship of the head modules is difficult.

It is an objective of the present invention to overcome the above problems and to provide an ink jet recording device capable of printing high quality images at a high printing speed wherein positional relationship among dot groups of head modules is accurately detected and electrically and automatically adjusted.

In order to overcome the above and other objectives, there is provided an ink jet recording device including at least one head module, deflecting means, a transporting means, a detection means, and a control means. The head module is formed with a row of a plurality of nozzles from which an ink droplet is selectively ejected onto a recording medium. The row extends in a first direction. The deflecting means deflects a flying direction of the ink droplet toward a second direction perpendicular to the first direction by a deflection amount. The ink droplet alights on an optional position of the recording medium. The transporting means transports the recording medium relative to the head modules in a third direction angled from the first direction. The detection means detects a positional error of the optional position with respect to a reference position. The control means controls the deflecting means to change the deflection amount in accordance with the positional error.

There is also provided a controlling method for controlling optional positions of ink droplets ejected from an ink jet recording device. The controlling method includes a) ejecting ink droplets from nozzles arranged in a row extending in a first direction, onto a recording medium transported relative to the nozzles in a second direction angled from the first direction, b) deflecting a flying direction of the ink droplets toward a third direction perpendicular to the first direction by a deflection amount, c) detecting a positional error of optional positions of the ink droplets having alighted on the recording medium with respect to a reference position, and d) controlling the deflection amount in accordance with the positional error.

BRIEF DESCRIPTION OF THE DRAWINGS

In the drawings:

FIG. 2(*b*) is an explanatory cross-sectional view showing change of impact positions of deflected ink droplets.

FIG. 3(*b*) is a view of nozzle driving signal;

FIG. 3(*c*) is a view of nozzle ejection timing;

FIG. 5(*b*) is a view of nozzle ejection signal;

FIG. 5(*c*) is a view of nozzle ejection timing;

FIG. 9(*b*) is a magnified view of line segment of the test pattern;

FIG. 10(*b*) is a magnified view of line segments of the test pattern;

FIG. 12(*b*) is a magnified view of line segment with an imaginary strait line with out the abnormal points.

PREFERRED EMBODIMENT OF THE PRESENT INVENTION

Next, a line scanning type ink jet recording device according to an embodiment of the present invention will be described while referring to the accompanying drawings.

Figure 1:
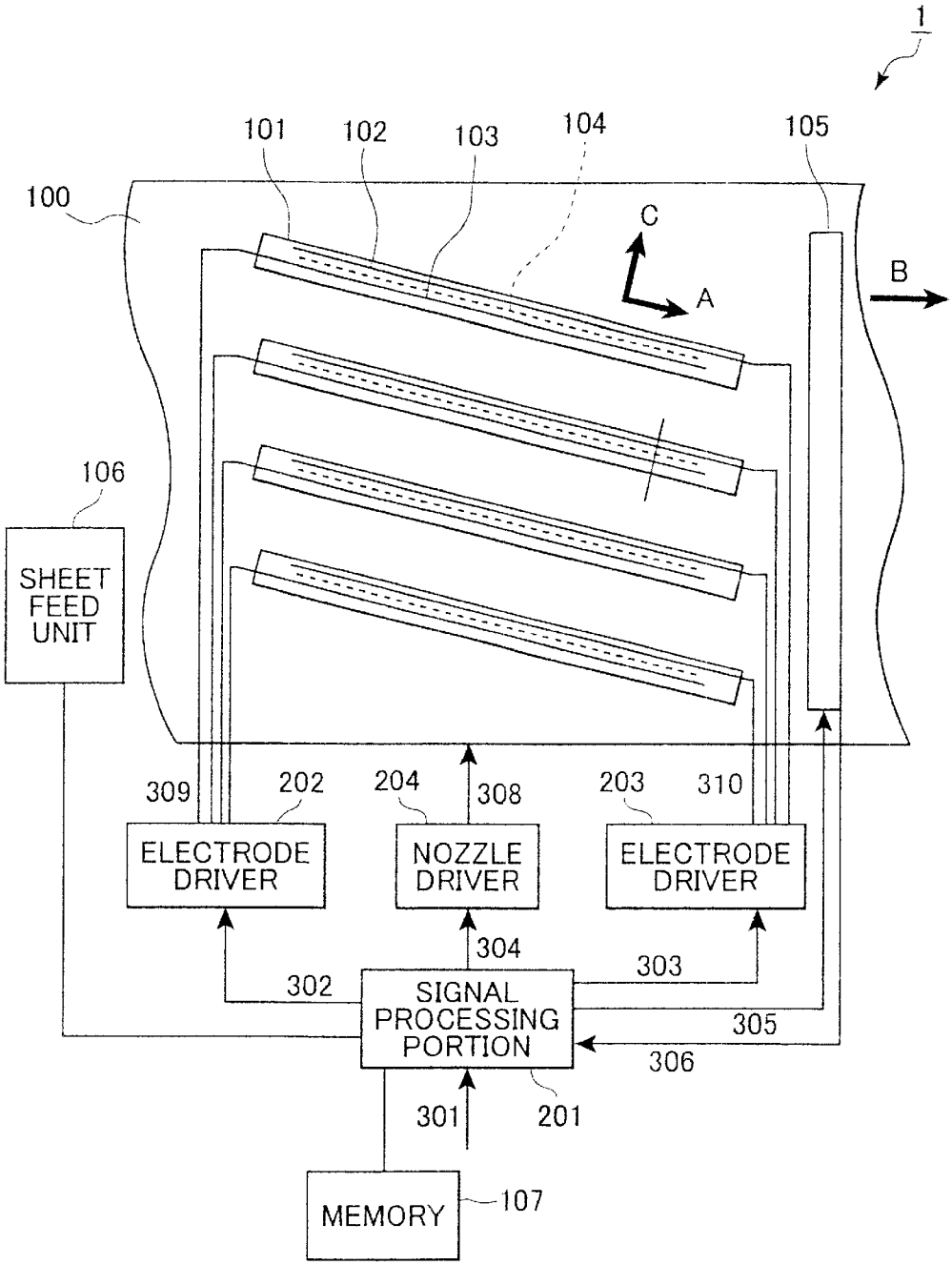
FIG. 1 is a plan view partially in block diagram of an ink jet recording device according to an embodiment of the present invention.

Referring to FIG. 1, a line scanning type ink jet recording device 1 of the present embodiment performs printing on a recording sheet 100, wherein ink droplets are ejected in response to an ink ejection input signal and deflected in their flying directions in response to a signal input to charging/deflecting electrodes.

As shown in FIG. 1, the recording device 1 includes a plurality of head modules 101, a light sensor 105, a sheet feed unit 106, a memory 107, a signal processing portion 201, charger/deflector electrode drivers 202, 203, and a nozzle driver 204. The head modules 101 are positioned to extend in a nozzle-line direction A angled from a sheet feed direction B. Each of the head modules 101 is formed with a nozzle line 104 including a plurality of nozzles for ejecting ink droplets. A pair of charger/deflector electrodes 102 and 103 are provided for each head module 101, extending parallel to the nozzle line 104.

Figures 3A, 3B, 3C:
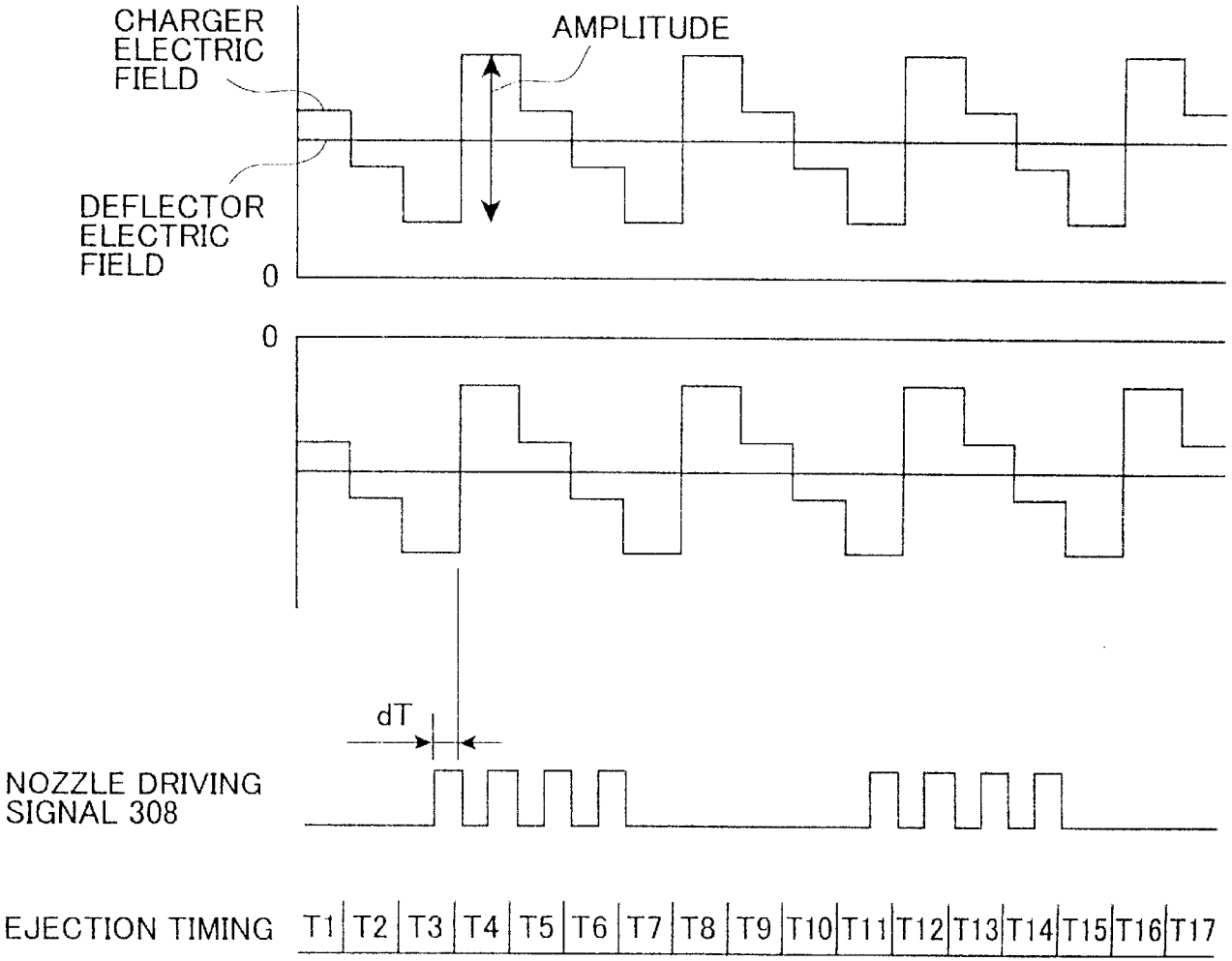
FIG. 3(*a*) is a view of charger and deflector field.

When printing is started, the sheet feed unit 106 starts feeding the recording sheet 100 in the direction B at a constant speed. The signal processing portion 201 receives a print data signal 301, based on which the signal processing portion 201 generates an ejection data signal 304 and charger/deflector data signals 302, 303. The nozzle driver 204 receives the ejection data signal 304 and in return generates a nozzle driving signal 308 and outputs the same to the nozzle line 104. As a result, an ink droplet is ejected from corresponding nozzle. The charger/deflector electrode drivers 202 and 203 receive the charger/deflector data signals 302 and 303, respectively, and then output charger/deflector voltages 309 and 310, which together generate a charger electric filed and a deflector electric field for the corresponding nozzle line 104. As shown in FIG. 3, the charger electric filed periodically changes its magnitude, and the deflector electric field has a constant magnitude.

The ink droplet ejected from the nozzle is charged by the charger electrostatic field, deflected in its flying direction by the deflector electric filed, and alights (impacts) on the recording sheet 100, thereby forming an image thereon.

The signal processing portion 201 also outputs an ejection data signal 304, and charger/deflector data signals 302, 303, and a light sensor control signal 305. The light sensor 105 detects a printed image in response to the light sensor control signal 305 and outputs an image detection data signal 306 to the signal processing portion 201. The signal processing portion 201 determines positions of the printed image as positions of the head modules 101 based on the received image detection data signal 306 and changes the ejection data signal 304 and charger/deflector data signals 302, 303 accordingly. The light sensor 105 includes, for example, precisely arranged lens, light, and CCD array, which enables detection of a high resolution image in a wide range.

Figure 2A:
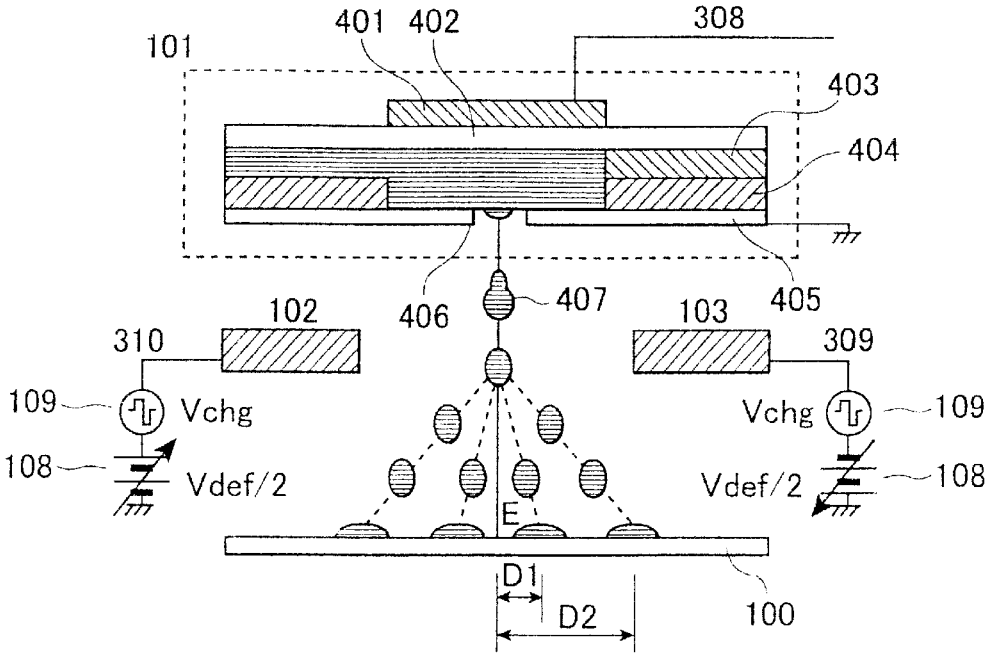
FIG. 2(*a*) is an explanatory cross-sectional view showing deflection of ink droplets.
Figure 2B:
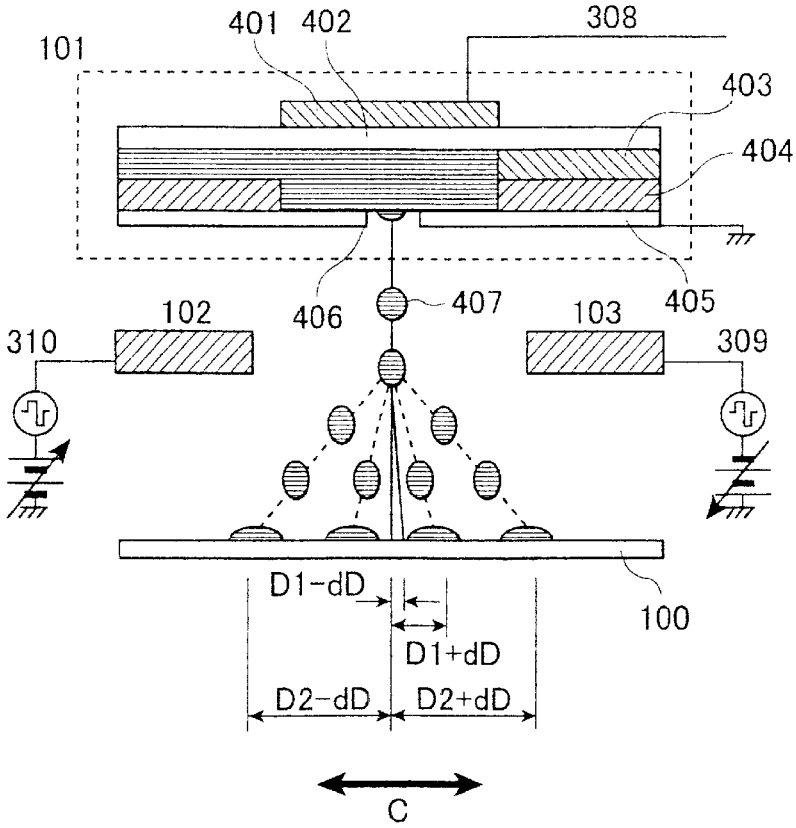

Next, a charging and deflecting mechanism will be described. As shown in FIG. 2(*a*), each head module 101 includes a piezoelectric element 401 formed from ceramic or the like, a diaphragm 402, a restrictor plate 403, a chamber plate 404 formed with an ink chamber, and an orifice plate 405 formed with a plurality of orifices 406 (only one is shown in FIG. 2(*a*)). The diaphragm 402, the restrictor plate 403, and the chamber plate 404 are formed from stainless steel, and the orifice plate 405 is formed from nickel, for example.

As shown in FIG. 2(*a*) the charger/deflector electrode drivers 202, 203 each includes an alternate current (AC) power source 109 and a direct current (DC) power source 108. The AC power source 109 outputs a charger voltage of Vchg. As will be described later, the magnitude of the charger voltage is changed among several different values in a predetermined frequency. The DC power sources 108 outputs a constant deflector voltage of Vdef/2. With this configuration, charger/deflector voltages 309, 310 (FIG. 1) of Vchg+Vdef/2 and Vchg−Vdef/2 are applied to the common electrodes 401 and 402, respectively. The orifice plate 405 is connected to the ground.

When the piezoelectric element 401 is applied with the nozzle driving signal 308, then the piezoelectric element 401 deforms and applies pressure to ink in the ink chamber via the diaphragm 402. As a result, an ink droplet 407 is ejected through the orifice 406. Because of the charger electrostatic field generated by the charger/deflector electrodes 102 and 103, the ink droplet 407 is charged by the amount corresponding to the charger electrostatic field at the time of ejection. Thus ejected and charged ink droplet 407 is then deflected by the deflector electric field. As a result, the ink droplet 407 flies in a direction deflected from an original flying direction E, along which the ink droplet 407 would have flown if not deflected. Accordingly, the optional position where the deflected ink droplet 407 alights (hereinafter referred to as "impact position") is shifted toward the electrode 102 or 103 by a deflection amount of D1 or D2.

The deflection amount with respect to the direction C can be adjusted by changing the magnitude of the deflector voltage generated at the DC power sauces 108, i.e., the charger/deflector voltages 309, 310. For example, when the charger/deflector voltages 309, 310 are changed by some amount, the resultant deflection amount will be, as shown in FIG. 2(*b*), D1+dD or D2+dD toward the electrode 103 and D1−dD or D2−dD toward the electrode 102. In this way, overall impact position of the ink droplet 407 is shifted by the amount dD.

Figure 4:
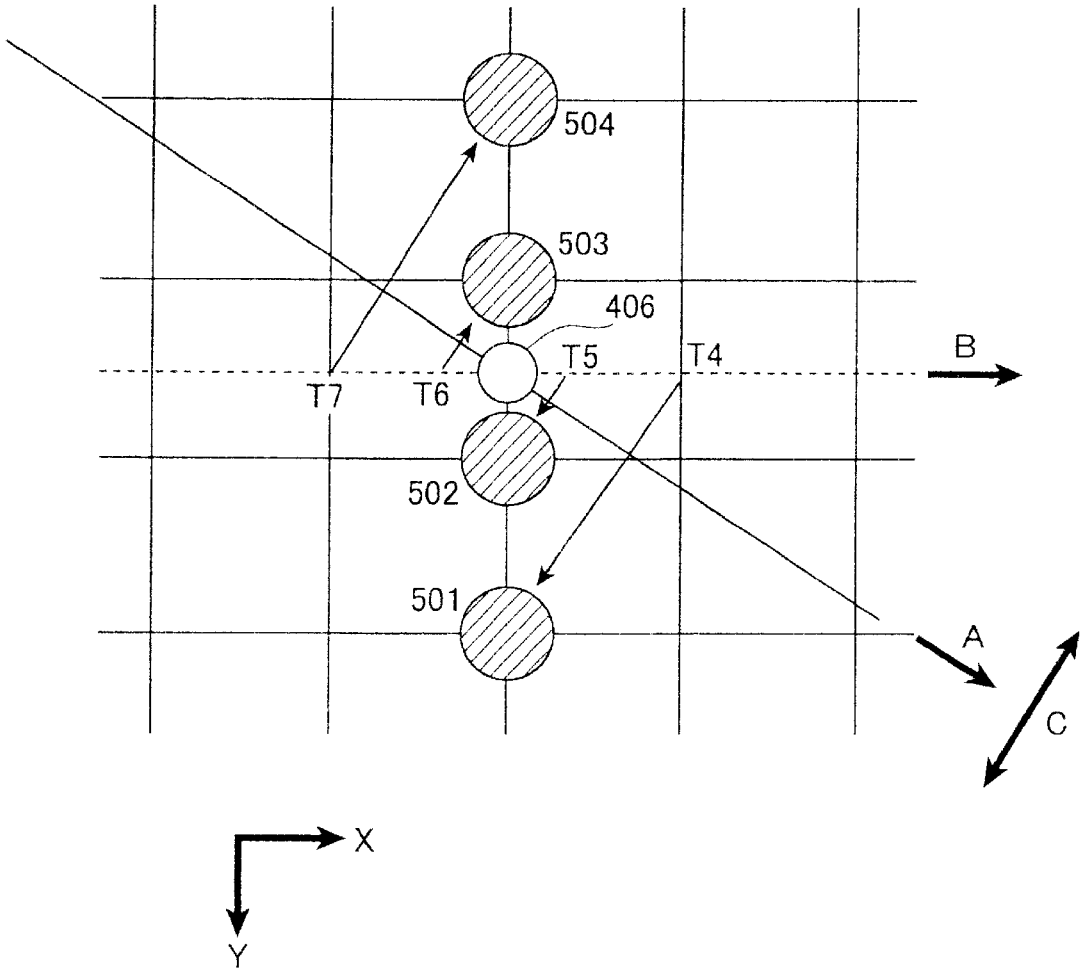
FIG. 4 is an explanatory view of impact positions with respect to a position of an orifice.

FIG. 3(*a*) shows the charger electrostatic field and the deflector electric field. In this example, an ink droplet 407 is deflected toward one of four directions, i.e., the number of deflection levels (deflection number) is four. As shown, a charger/deflector electric field is generated by the combination of the charger electrostatic field as a periodical AC component and the deflector electric field as a DC component. FIG. 3(*b*) shows the nozzle driving signal 308, and FIG. 3(*c*) shows an ejection timing of ink droplet. Because there is a time lag from when the nozzle driver 204 outputs the nozzle driving signal 308 to the piezoelectric element 401 until when the ink droplet 407 is actually ejected from the nozzle, the nozzle driver 204 outputs the nozzle driving signal 308 dT time period earlier than a target ejection timing. Printing result is schematically shown in FIG. 4. In order to facilitate the explanation, X-Y coordinate system is shown in FIG. 4, where the X direction is parallel to the sheet feed direction B.

In FIG. 4, the recording sheet 100 is being fed in the sheet feed direction B. At the timing T4 of FIG. 3(*c*), the charger electrostatic field is large as shown in FIG. 3(*a*), so that an ink droplet ejected at the timing T4 is deflected in the deflection direction C perpendicular to the nozzle line direction A by a relatively large amount, and impacts on a grid corner 501. An ink droplet ejected at the timing T5 of FIG. 3(*c*) is deflected by an amount corresponding to the charger electrostatic field at that time, and impact on a grid corner 502. At the timing T6, the polarity of the charger electrostatic field is opposite from that at the timing T4 or T5. Accordingly, an ink droplet ejected at the timing T6 is deflected to the direction opposite from 501, 502, and impact on a grid corner 503. The ink droplet ejected at the timing T7 is deflected greater than that of the timing T6, and impacts on a grid corner 504. In this manner, dots can be formed on grid corners.

However, because of imprecise assembly of the head modules 101, dots may not be formed on target positions on the grid corners, i.e., impact position may be improper. In this case, the position shift with respect to the X and Y directions is adjusted. Specifically, the position shift with respect to the direction Y is corrected by changing the deflection amount. The deflection amount can be changed by controlling the magnitude of the deflector electric field, i.e., the charger/deflector voltage 309 and 310, in a manner described above. The position shift with respect to the X direction is adjusted by changing the ejection timing of ink droplet. It should be noted that in order to change the ejection timing, the output timing of the charger/deflector voltages 309 and 310 is changed as well as the output timing of the nozzle driving signal 308. Details will be described while referring to an example of FIG. 6.

Figure 6:
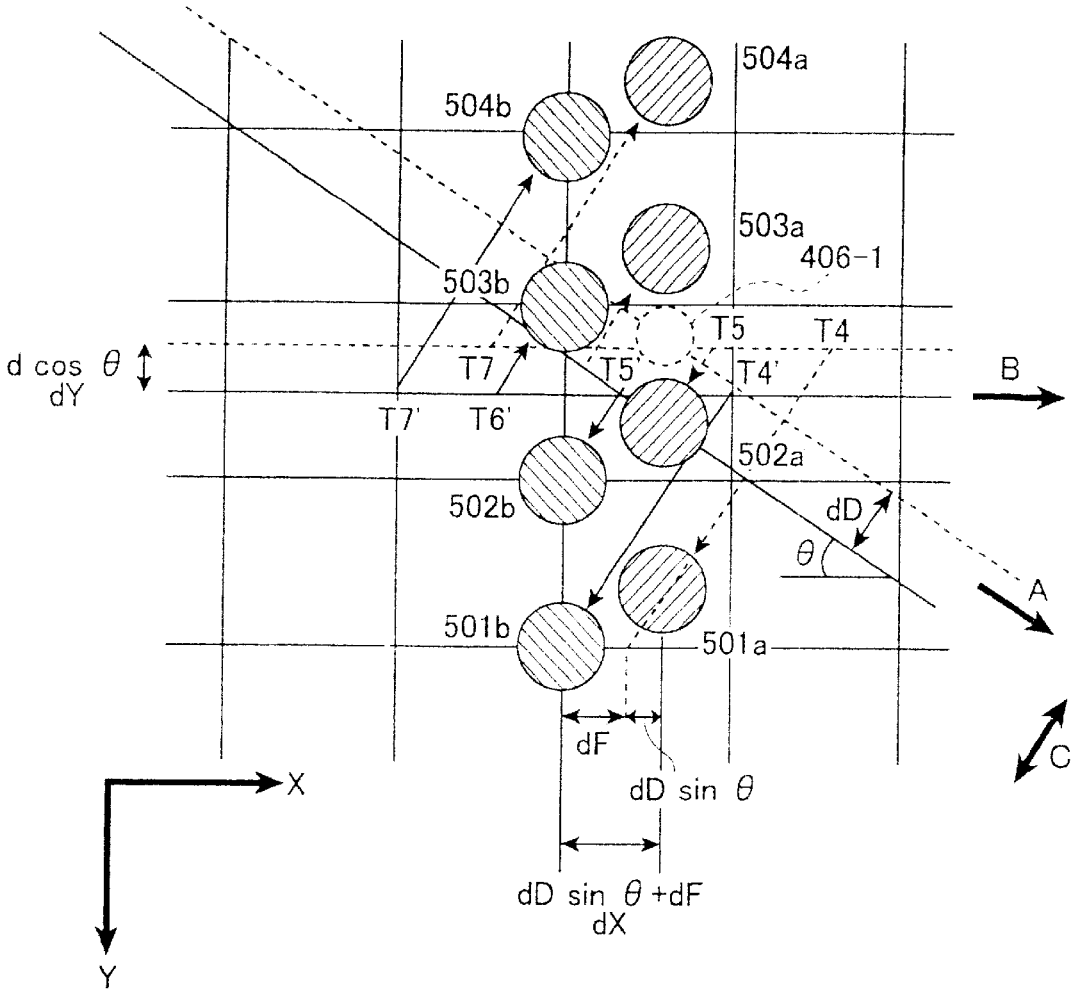
FIG. 6 is an explanatory view of impact positions.
Figure 7:
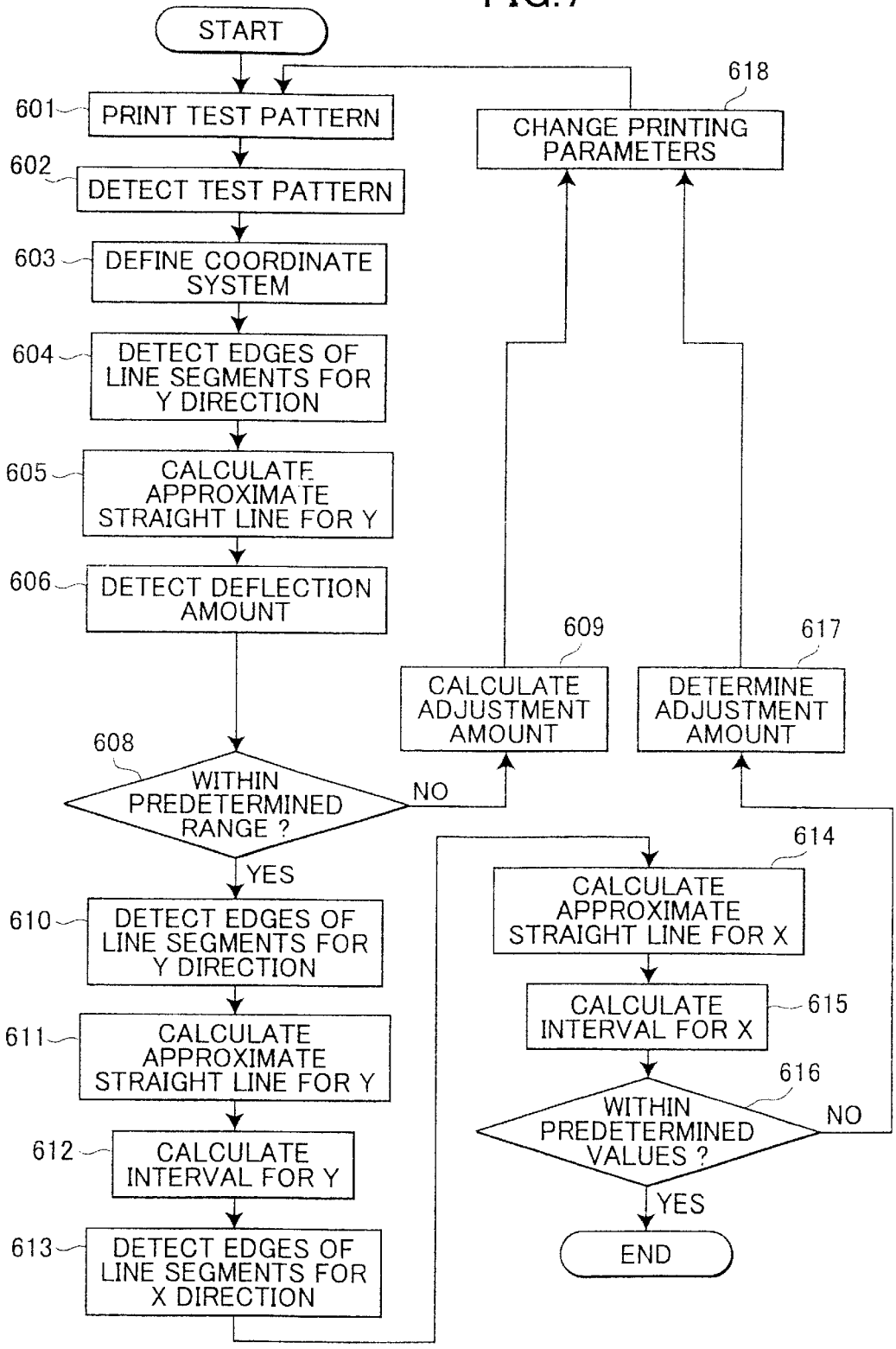
FIG. 7 is an explanatory view of test pattern printing.

In FIG. 6, it is assumed that ink droplets ejected at the timings of T4, T5, T6, T7 from the orifice 406 at a position 406-1 impact on positions 501*a*, 502*a*, 503*a*, 504*a*, respectively, which are shifted from target positions 501*b*, 502*b*, 503*b*, 504*b* by an amount dX in the X direction and an amount dY in the Y direction. In order to overcome this problem, the positions 501*a*, 502*a*, 503*a*, 504*a* are shifted by an amount dD in the direction C and also by an amount dF in the direction B. The relationship among the amounts dD, dF, dX, and dY is defined in the following equations:

$$dY = dD \cos\theta$$

$$dX = dD \sin\theta + dF$$

Figures 5A, 5B, 5C:
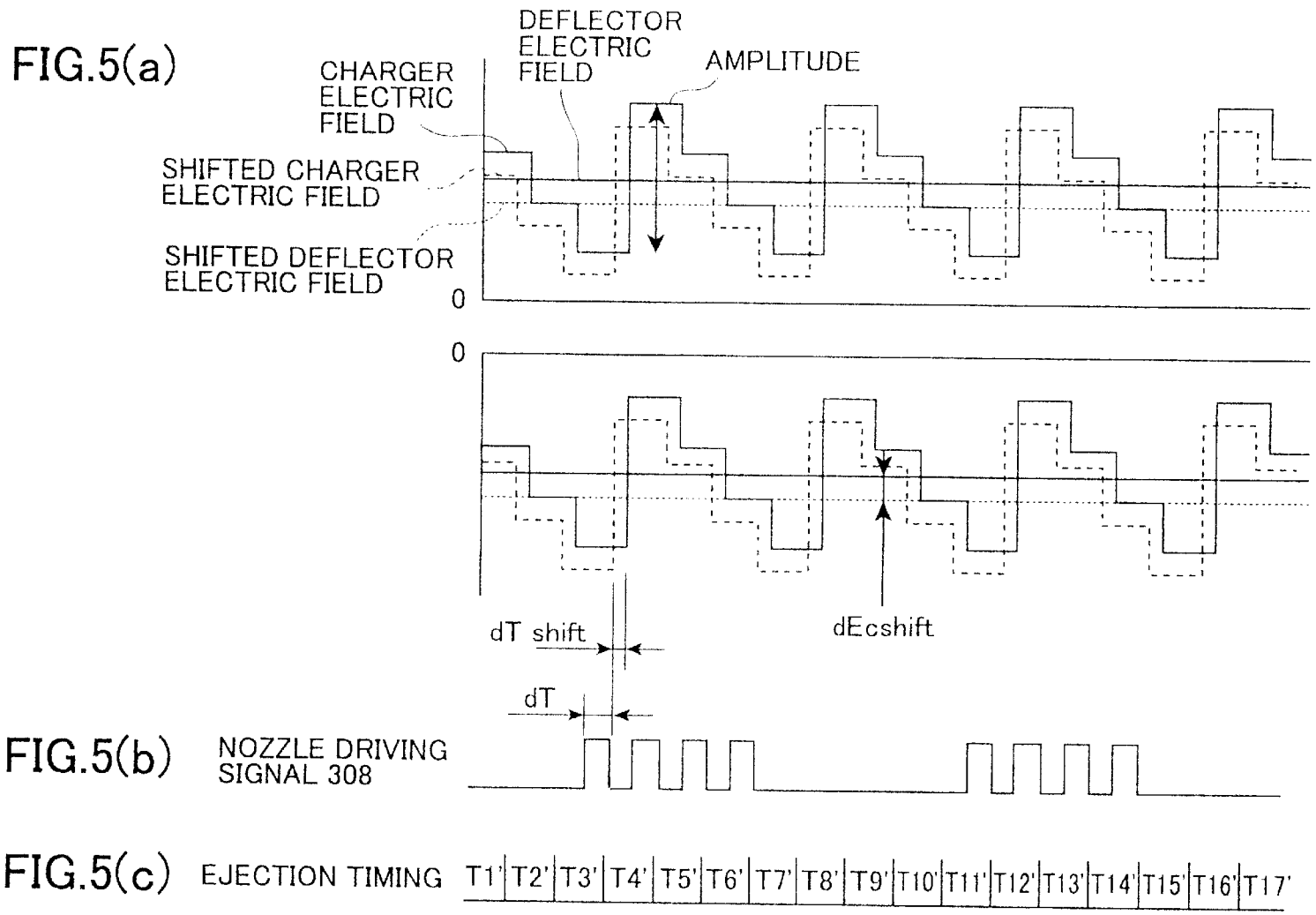
FIG. 5(*a*) is an explanatory view of shift of charger and deflector fields.

The deflecting amount, i.e., the impact position with respect to the deflection direction C, is changed by changing the deflector electric field in the manner described above. Accordingly, by changing the deflector electric field by a shifting amount of dEcshift (FIG. 5(*a*)) such that the changed amount with respect to the Y direction will be the amount of dY, i.e., dDcos θ, the position shift is adjusted with respect to the Y direction.

When the deflector electric field is changed by the shifting amount dEcshift, the impact position is also changed by an amount of dDsin θ with respect to the X direction. Therefore, necessary positional adjustment dF with respect to the X direction will be dX−dDsin θ. Accordingly, the ejection timing is shifted by a time period dTshift, which is required to feed the recording sheet 100 by the distance of dX−dDsin θ. The output timings of the nozzle driving signal 308 and of the charger/deflector voltages 309 and 310 are shifted by the time period dTshift. In this way, the positions 501*a*, 502*a*, 503*a*, 504*a* are corrected to the positions 501*b*, 502*b*, 503*b*, 504*b*.

Next, operations for detecting the shifting amount of ink-droplet impact positions, i.e., for detecting the above amounts dY and dX, and also operations for correcting the impact positions will be described while referring to the flowchart of FIG. 7 and FIGS. 8 through 12.

Figure 8:
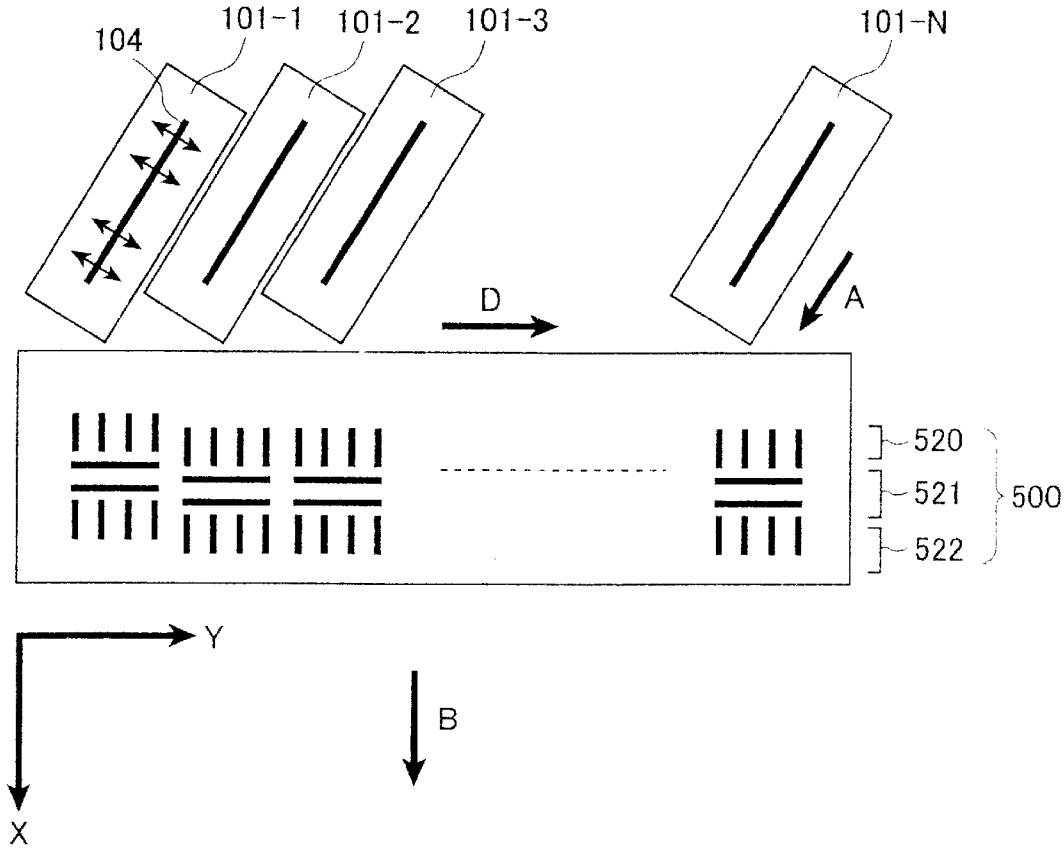
FIG. 8 is a flowchart representing a process executed in the embodiment of present invention.

First, in S601, test patterns 500 of FIG. 8 are printed by all the nozzles of head modules 101-1, 101-2, . . . , 101-N, such that the test patterns 500 do not overlap one another. Each test pattern 500 includes a deflection amount detection pattern 520, an X-position detection pattern 521, and a Y-position detection pattern 522. The deflection amount detection pattern 520 is for detecting the deflection amount of ink droplets and used for correcting the amplitude of the charger voltage. The X-position detection pattern 521 is used for detecting and correcting the ink-droplet impact positions with respect to the X-direction. The Y-position detection pattern 522 is used for detecting and correcting the ink-droplet impact positions with respect to the Y direction.

In FIG. 8, the deflection amount detection pattern 520 and the Y-position detection pattern 522 include a plurality of line segments extending in the sheet feed direction B, and the X-position detection pattern 521 includes a plurality of line segments extending in a direction D perpendicular to the sheet feed direction B.

It should be also noted that although the patterns 520, 522 of FIG. 8 each includes four line segments only, FIG. 8 is a simplified diagram and the patterns 520, 522 include more than four line segments as described below.

Next in S602, the light sensor 105 detects the test patterns 500, generates corresponding digital image data, and stores the digital image data into the memory 107.

In S603, an imaginary coordinate system is defined and superimposed on the image data. Although, any type of coordinate system can be used, X-Y coordinate system is used in this example. As shown in FIG. 8, the X and Y directions are in parallel with the directions B and D, respectively. This is merely for facilitating the explanation. The X, Y directions can be angled with respect to the directions B and D. Also, the line segments of the print patterns 500 can be angled with respect to the directions B and D.

Next, deflection amounts are adjusted before detecting and correcting the ink-droplet impact positions with respect to the X and Y directions, because improper deflection amount affects on the impact position in the Y direction. Details will be described.

Figure 10A:
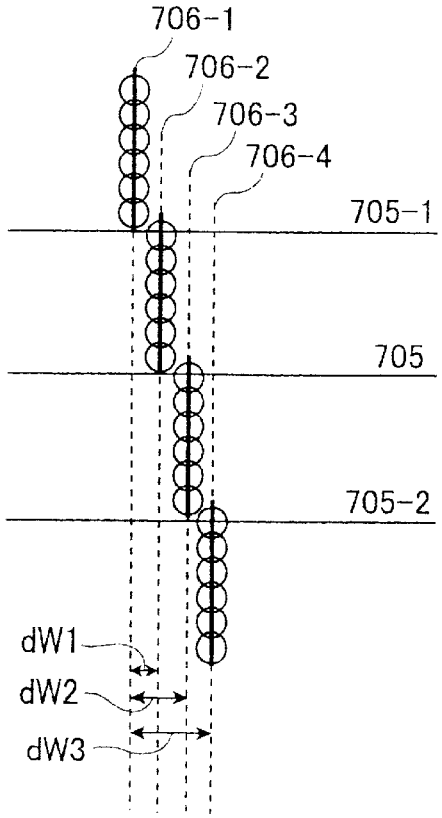
FIG. 10(*a*) is a magnified view of line segments of the test pattern.
Figure 10B:
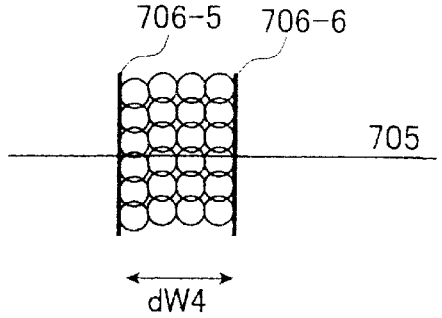
Figure 10B:
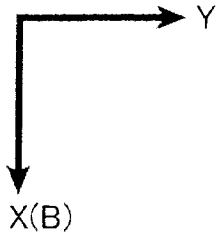
Figure 11:
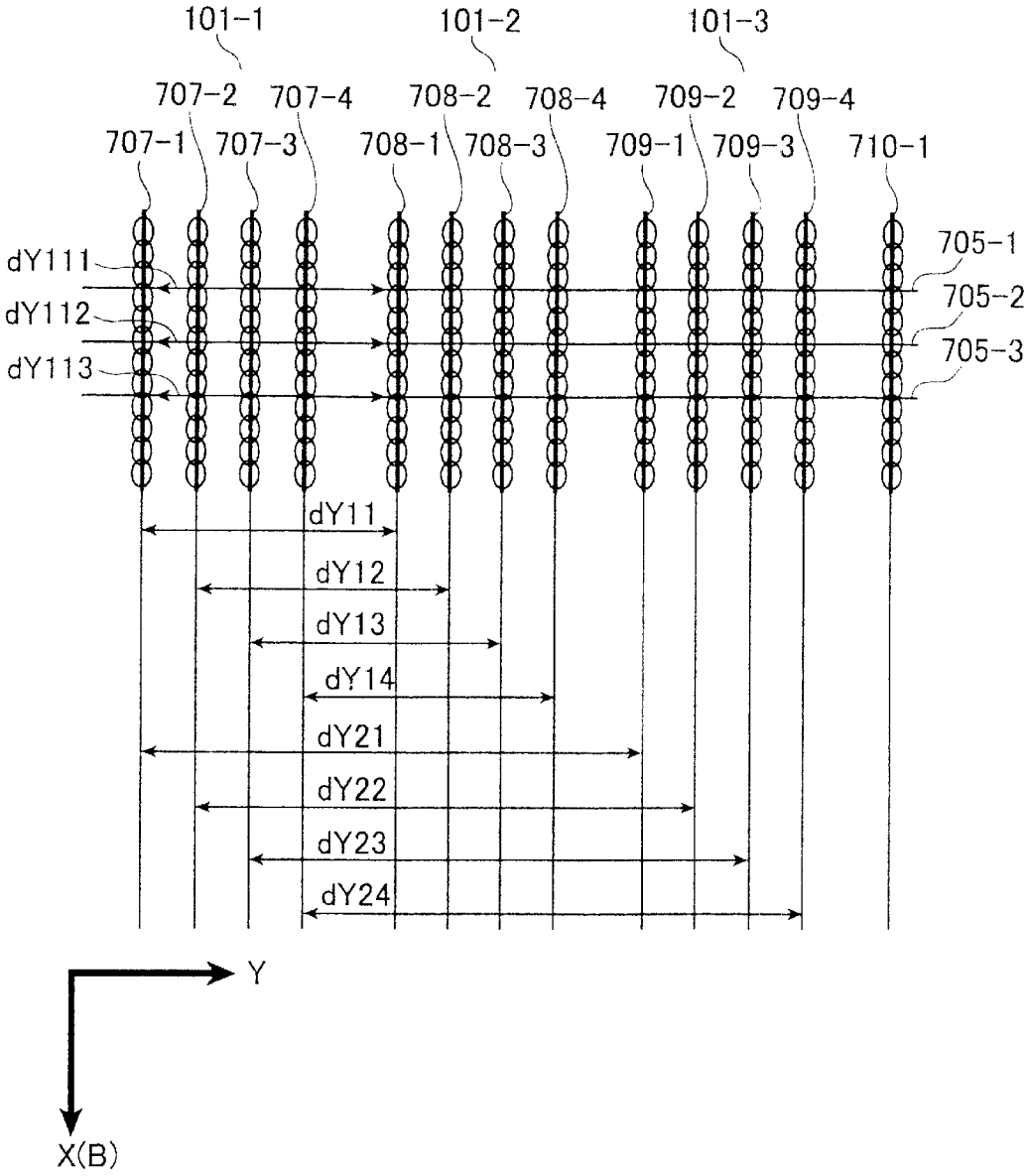
FIG. 11 is an explanatory view showing a method for detecting head widths.

FIG. 10(*a*) is a magnified view of a portion of the deflection amount detection pattern 520, showing the portion, which is a pattern printed by a single nozzle. Because the deflection number is four as described above, four line segments are printed at different deflection while shifting their positions in the X direction. The same patterns are printed by the all nozzle of each print head 101.

In S604, edges of each line segment of the deflection amount detection pattern 520 are detected, and then in S605, an approximate straight line is calculated from the detected edges. The edge indicates an outer periphery of the printed dot of the line segment in the present example. Details will be described while referring to FIG. 9.

Figure 9A:
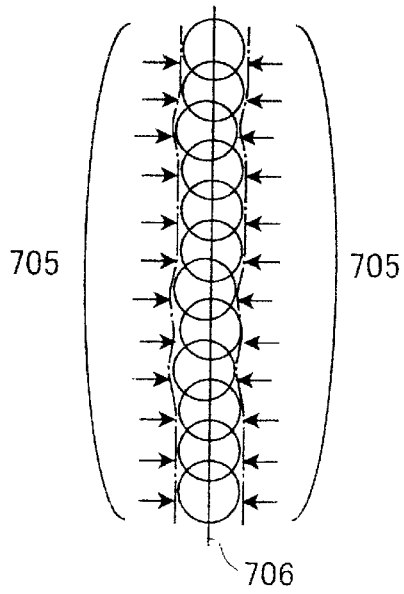
FIG. 9(*a*) is a magnified view of line segment of test pattern.
Figure 9B:
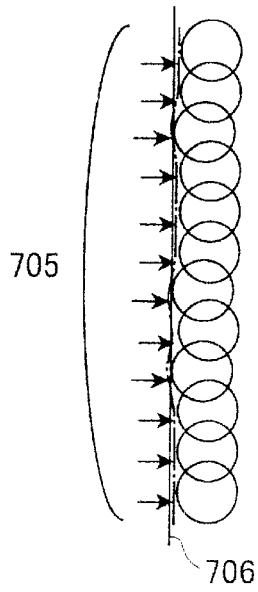

With respect to the digital data stored in the memory 107, 2×2 data masking is performed. When the data-set arrangement of the masked data matches with one of previously set arrangements, the masked portion of the digital data is determined to be on the edge of the digital data. This operation is performed at a predetermined interval for detecting a plurality of edges of the line segment. Resultant edges 705 are shown in FIGS. 9(*a*) and 9(*b*). Then, the coordinate values of the detected edges 705 are stored in the memory.

Next, an approximate straight line 706 is calculated from the stored coordinate values of the edges 705 by least squares method, for example. FIG. 9(*a*) shows an example where the edges 705 at the both sides of the line segment are detected, and a center line thereof is obtained as the approximate straight line 706. The same process is performed for every line segments. It should be noted that in order to save the data amount and realizing a high speed processing, the edges 705 at only one side can be detected instead as shown in FIG. 9(*b*).

Next, in S606, the deflection amount is detected. In FIG. 10(*a*), approximate straight lines 706-1, 706-2, 706-3, 706-4 have been obtained in the manner described above. With respect to the approximate straight lines 706-1, 706-2, 706-3, 706-4, intersections to an imaginary reference line (reference position) 705 extending in the Y direction are detected. Distances dW1, dW2, dW3 between two of these intersections are the deflection amounts of the corresponding deflection levels. The reason for using the intersections is that because the approximate straight lines 706-1, 706-2, 706-3, 706-4 are not always parallel to one another. In order to suppress the detection error, it is preferable to obtain the imaginary reference line 705 near the line segments. In this example, the imaginary reference line 705 is provided at the substantial center of the entire length of the all line segments with respect to the X direction.

Alternatively, a plurality of imaginary reference lines 705-1, 705, 705-2 can be used for calculating the widths dW1, dW2, dW3, respectively, and average amounts thereof can be calculated. The calculation would be less complex when an entire width dW4 between approximate straight lines 706-5 and 706-6 at the sides of the line segments is calculated as shown in FIG. 10(*b*), rather than the widths dW1, dW2, dW3 for each deflection levels are calculated.

The same process is performed for other nozzles, and an average deflection amount is calculated.

Then, in S608, it is determined whether the above-obtained average deflection amount is within a predetermined range stored in the memory 107. If not (S608:NO), then in S609, a necessary adjustment amount is calculated. This calculation is performed based on a prepared relation between a deflection amount and a charger voltage. Specifically, the deflection amount is changed by controlling the magnitude of the charger voltage, that is, the amplitude of the charger electrostatic field (See FIG. 3(*a*)).

Then, in S618, printing parameters are changed based on the obtained adjustment amount, and the test pattern is again printed in S601 by the changed parameter. In this way, the deflection amounts are adjusted before detecting and correcting the ink-droplet impact positions with respect to the X and Y directions. It should be noted that the printing parameters includes the charging voltage, the deflector voltage, the ink ejection timing, the charging/deflecting timing, and the like.

If the deflection amounts are within the predetermined ranges (S608:YES), then the ink-droplet impact positions with respect to the Y direction are detected and corrected in a manner described next.

First, in S610, the edges of the line segments are detected for the Y position detection pattern 522 in the same manner as in S604, and then in S611, approximate straight lines are calculated in the same manner as in S605. Next, in S612, an average interval between the line segments is calculated to determine module intervals. Details will be described while referring to an example of FIG. 11, wherein each head module 101 has printed four line segments of the Y-position detection pattern 522. Approximate straight lines 707-1 through 707-4 have been obtained for the corresponding line segments printed by the head module 101-1, approximate straight lines 708-1 through 708-4 for the line segments by the head module 101-2, approximate straight lines 709-1 through 709-4 for the line segments by the head module 101-3, and on. Also, the imaginary reference lines 705-1, 705-2, 705-3, . . . in the Y direction have been provided.

First, intersections of the imaginary reference lines 705-1, 705-2, 705-3 and the approximate straight lines 707-1, 707-2, . . . are determined, and intervals between the intersections are calculated. A line interval dY111 between the intersections of the imaginary reference line 705-1 and each of the approximate straight lines 707-1, 708-1 is calculated. Similarly, line intervals dY112, dY113 . . . are calculated for the approximate straight lines 707-1 and 708-1 with respect to the imaginary reference lines 705-2, 705-3. Then, an average interval DY11 is calculated from the intervals dY111, dY112, dY113.

Average intervals dY12, dY13, and dY14 are calculated for other line segments in the same manner. Then, an average of intervals dY11, dY12, dY13, dY14 is calculated as a module interval dY1 by an equation:

$$dY1=(dY11+dY12+dY13+dY14)/4$$

The module interval dY1 actually indicates a distance between dot groups printed by corresponding one of two adjacent head modules 101-1 and 101-2 and is considered as an interval of the head modules 101-1 and 101-2 in this embodiment.

The module interval dY1 is compared to a predetermined first width for the head module 101 so as to calculate the difference therebetween. Thus calculated difference indicates the amount of position shift, i.e., necessary adjustment amount dY, with respect to the Y direction between the head modules 101-1 and 101-2. The predetermined first width is stored in the memory 107.

In the same manner, average intervals dY21 through dY24 are obtained, and a module interval dY2 is obtained in the same manner by an equation:

$$dY2=(dY21+dY22+dY23+dY24)/4$$

The module interval dY2 actually indicates a distance between dot groups printed by corresponding one of two adjacent head modules 101-1 and 101-3, and is considered as an interval between the head modules 101-1 and 101-3.

The module interval dY2 is compared to a predetermined second interval stored in the memory 107 for obtaining a difference therebetween, which is the adjustment amount dY between the head modules 101-1 and 101-3.

The similar operation is repeatedly performed for intervals between the head modules 101-1 and one of the remaining head modules 101-4 through 101-N.

Then, the same processes are executed in S613 through S615 for obtaining the adjustment amount dX. The processes of S613 through S615 are the same as those of S610 through S612 except that the angle on the special coordinate differs by 90 degrees.

There are alternative methods for calculating the adjustment amount. However, one thing that anyone should be careful about when selecting the method is to avoid integration of the adjustment amount dY. When measuring the error amounts only between the adjacent head modules 101, there is a possibility that the integrated adjustment amount dY exceeds a possible adjustment range when the printer includes a large number of head modules. When the resultant adjustment amount dY becomes too large and exceeds the possible adjustment range, then the printer will need to have a complex configuration.

For example, a module interval is obtained for each adjacent two of the head modules, and an average of the module intervals is calculated. Then, the difference between the average and each module interval is determined to be an adjustment amount dY for corresponding adjacent two head modules. In this case, there is no need to store predetermined module interval, such as the predetermined first and second module intervals, in the memory 107.

Alternatively, an optional reference position is determined, and average of the positional errors of the head modules 101 with respect to the optional reference position is calculated. Then, the reference position is shifted by the obtained average amount, and differences between the positional errors and the average amount are calculated as adjustment amounts.

For example, first, an actual center dYave of the line segments is calculated by the formula:

$$dYave=(dY1+dY2+dY3+\ldots+dY(N-1))/N)$$

Also, predetermined distances cY1, cY2, cY3 . . . cYN between a predetermined center and a position of each module 101 nozzle are previously stored in the memory 107. Then, the adjustment amounts dY can be calculated for each module 101 in a formula:

$$dYave-cY1$$

$$dYave-cY2$$

$$dYave-cY3$$

$$dYave-cYN$$

Then in S616, it is detected whether the adjustment amounts dY, dX are within the predetermined X·Y position tolerable values. If so (S616:YES), then the routine is ended. If not, shifting amounts the deflection-voltage and ink ejection timing are determined in S617 in the manner explained referring to FIGS. 5 and 6. Then, the printing parameters are adjusted accordingly in S618. The same process is repeated until the adjustment amounts become within the predetermined range.

Figure 12:
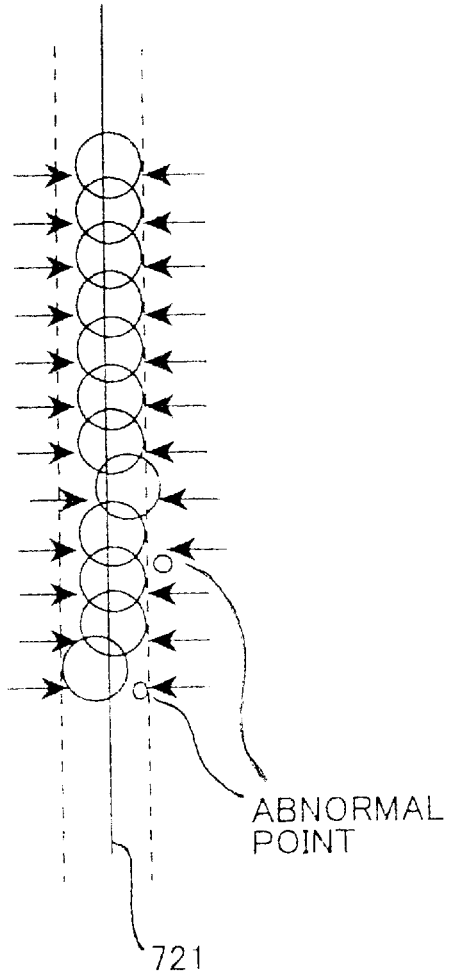
FIG. 12(*a*) is a magnified view of line segment with an imaginary strait line with abnormal points.
Figure 12:
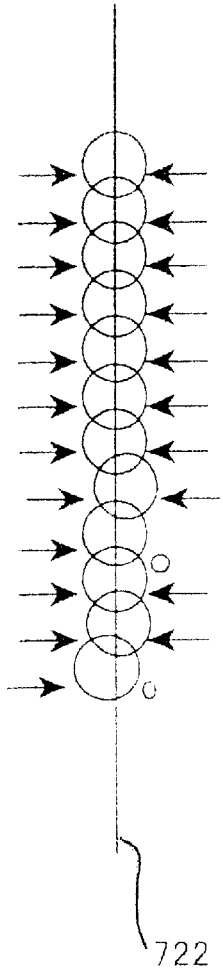

FIG. 12 shows an example method for obtaining an approximate straight line while removing abnormal points so as to realize a highly precise positioning of the head modules 101. When splashed ink with satellite droplets shown in FIG. 12 is caused, then the image quality is degraded. This results in detection error at edge detection, causing inaccurate approximate straight line. In order to avoid this problem, first, an approximate straight line 721 is obtained based on the edges of the line segments, which are obtained from image data. Then, interval is estimated for confidence interval. Edge data differs from the approximate straight line 721 by a large amount is considered defective, and deleted from the edge data. Then, the approximate straight line 722 is obtained based on the corrected edge data. In this way, the degrading factor of the image, such as satellite droplets, is removed, and so a highly precise position correction is possible.

According to the present invention, a positional relationship among the printed dot groups printed by a plurality of head modules can be accurately determined and electrically and automatically adjusted. Therefore, the problem of the positional shifts of the assembled head modules, which is inevitable during the assembly, can be overcome by adjusting the impact positions of ink droplets without actually and mechanically moving the physical position of the head modules.

Because the test patterns 500 are printed by all nozzles of the head modules 101, uneven characteristics among then nozzles will much less affect the quality of the printed patterns 500 compared with the above-described conventional case. Therefore, correction of the impact positions can be accurate.

This is striking especially when multiple printing is performed, where a plurality of ink droplets is ejected onto a single impact position or predetermined relative positions. The multiple printing is performed in multicolor printing, for example. Because the impact positions are corrected in an accurate manner, a high quality image without distinct borderline in joint regions of head modules or misalignment of colored dots can be obtained.

While some exemplary embodiments of this invention have been described in detail, those skilled in the art will recognize that there are many possible modifications and variations which may be made in these exemplary embodiments while yet retaining many of the novel features and advantages of the invention.

For example, although the test pattern 500 of the above example includes both the deflection amount detection pattern 520 and the Y-position detection pattern 522, the Y-position detection pattern 522 can be omitted so that the deflection amount detection pattern 520 functions also as a Y position detection pattern.

What is claimed is:

1. An ink jet recording device comprising:

at least one head module formed with a row of a plurality of nozzles from which an ink droplet is selectively ejected onto a recording medium, the row extending in a first direction;

a deflecting means for deflecting a flying direction of the ink droplet toward a second direction perpendicular to the first direction by a deflection amount, wherein the ink droplet alights on an optional position of the recording medium;

a transporting means for transporting the recording medium relative to the head modules in a third direction angled from the first direction;

a detection means for detecting a positional error of the optional position with respect to a reference position; and a control means for controlling the deflecting means to change the deflection amount in accordance with the positional error.

2. The ink jet recording device according to claim 1, further comprising an ejection means for ejecting an ink droplet from each of the nozzles at an ejection timing, wherein the control means controls the ejection timing in accordance with the positional error.

3. The ink jet recording device according to claim 2, wherein the ejection means ejects ink droplets to form a test pattern on the recording medium, and the detection means detects the positional error of the optional position based on a position of the test pattern and the reference position.

4. The ink jet recording device according to claim 2, further comprising a calculation means, wherein:

the ejection means ejects ink droplets to form a test pattern on the recording medium, test pattern including a line segment;

the detection means detects the line segment and generates corresponding line data;

the calculation means calculates an approximate straight line of the line segment based on the line data;

the detection means detects the positional error of the optional position based on a distance between the approximate straight line of the line segment and the reference position.

5. The ink jet recording device according to claim 4, wherein the calculation means includes data processing means that removes an abnormal point from the line data based on the straight line to generate a modified line data, and the calculation means calculates an approximate straight line based on the modified line data.

6. The ink jet recording device according to claim 1, further comprising an ejection means for ejecting an ink droplet from each of the nozzles at an ejection timing, wherein the ejection means ejects ink droplets to form a test pattern on the recording medium, test pattern including a line segment;

the detection means detects the line segment and generates corresponding line data;

the calculation means calculates an approximate straight line of the line segment based on the line data;

the detection means further detects a first distance between the approximate straight line and the reference position with respect to the third direction and a second distance between the approximate straight line and the reference position with respect to the second direction; and the control means controls the deflecting means to change the deflection amount in accordance with the first distance and further controls the ejection timing in accordance with the second distance.

7. The ink jet recording device according to claim 6, wherein the reference position is indicated by at least one reference line, and the test pattern includes at least one line segment, the detection means detects the first distance and the second distance based on a plurality of intersections of the at least one reference line and at least one approximate straight line of the at least one line segment.

8. The ink jet recording device according to claim 6, wherein the calculation means includes data processing means that removes an abnormal point from the line data based on the approximate straight line to generate a modified line data, and the calculation means calculates an approximate straight line based on the modified line data.

9. The ink jet recording device according to claim 1, wherein the ink droplet is ejected from every one of the nozzles to form a pattern on the recording medium, and the detecting means detects the positional error of the optional position based on the pattern.

10. The ink jet recording device according to claim 1, wherein the deflecting means includes a charger that charges an ink droplet and a deflector that generates an electrostatic field for deflecting the ink droplet charged by the charger.

11. A controlling method for controlling optional positions of ink droplets ejected from an ink jet recording device, the controlling method comprising the steps of:

a) ejecting ink droplets from nozzles arranged in a row extending in a first direction, onto a recording medium transported relative to the nozzles in a second direction angled from the first direction;

b) deflecting a flying direction of the ink droplets toward a third direction perpendicular to the first direction by a deflection amount;

c) detecting a positional error of optional positions of the ink droplets having alighted on the recording medium with respect to a reference position; and d) controlling the deflection amount in accordance with the positional error.

12. The controlling method according to claim 11, further comprising the step of e) controlling ejection timings to eject the ink droplets from the nozzles in accordance with the positional error.

13. The controlling method according to claim 12, wherein the ejected ink droplets forms a test pattern on the recording medium, and the positional error is detected based on a position of the test pattern and the reference position.

14. The controlling method according to claim 13, wherein the step c) includes the steps of:

f) detecting a line segment of the test pattern;

g) generating line data of the line segment; and h) calculating an approximate straight line of the line segment based on the line data, and the step c) detects the positional error based on a distance between the approximate straight line of the line segment and the reference position.

15. The controlling method according to claim 14, wherein the step g) includes the steps of i) removing abnormal point from the line data based on the approximate straight line to generate a modified line data, and j) recalculating an approximate straight line based on the modified line data.

16. The controlling method according to claim 11, wherein the ejected ink droplets forms a test pattern on the recording medium, and the step c) includes the steps of:

k) detecting a line segment of the test pattern;

l) generating line data of the line segment;

m) calculating an approximate straight line of the line segment based on the line data; and n) detecting a first distance between the approximate straight line and the reference position with respect to the second direction and a second distance between the approximate straight line and the reference position with respect to the third direction, and the step d) includes the steps of:

o) controlling the deflection amount in accordance with the first distance; and p) controlling the ejection timing in accordance with the second distance.

17. The controlling method according to claim 11, wherein the step c) detects the positional error of the optional position of the ink droplets which has been ejected from all of the nozzles.

* * * * *